US010571213B1

(12) United States Patent
Sugg

(10) Patent No.: US 10,571,213 B1
(45) Date of Patent: Feb. 25, 2020

(54) FIREARM BOLT

(71) Applicant: Edward A. Sugg, South Riding, VA (US)

(72) Inventor: Edward A. Sugg, South Riding, VA (US)

( * ) Notice: Subject to any disclaimer, the term of this patent is extended or adjusted under 35 U.S.C. 154(b) by 0 days.

(21) Appl. No.: 15/732,671

(22) Filed: Dec. 12, 2017

Related U.S. Application Data

(63) Continuation-in-part of application No. 15/732,225, filed on Oct. 6, 2017, now abandoned, and a continuation-in-part of application No. 15/248,525, filed on Aug. 26, 2016, now Pat. No. 10,151,544.

(60) Provisional application No. 62/530,297, filed on Jul. 10, 2017, provisional application No. 62/432,739, filed on Dec. 12, 2016, provisional application No. 62/366,110, filed on Jul. 24, 2016, provisional application No. 62/342,460, filed on May 27, 2016, provisional application No. 62/326,762, filed on Apr. 24, 2016, provisional application No. 62/325,991, filed on Apr. 21, 2016, provisional application No. 62/320,432, filed on Apr. 8, 2016, provisional application No. 62/311,874, filed on Mar. 22, 2016, provisional application No. 62/310,486, filed on Mar. 18, 2016, provisional application No. 62/279,887, filed on Jan. 18, 2016, provisional application No. 62/245,834, filed on Oct. 23, 2015, provisional application No. 62/210,278, filed on Aug. 26, 2015, provisional application No. 62/411,538, filed on Oct. 22, 2016, provisional application No. 62/405,195, filed on Oct. 6, 2016.

(51) Int. Cl.
*F41A 15/00* (2006.01)
*F41A 35/06* (2006.01)
*F41A 3/42* (2006.01)

(52) U.S. Cl.
CPC ..... *F41A 35/06* (2013.01); *F41A 3/42* (2013.01)

(58) Field of Classification Search
CPC ..... F41A 15/12; F41A 15/14; F41A 15/16
USPC ..... 42/46, 25
See application file for complete search history.

(56) References Cited

U.S. PATENT DOCUMENTS 7,469,496 B1 * 12/2008 Kellgren ..... F41A 15/10 42/46
2014/0075807 A1 * 3/2014 Lewis ..... F41A 15/14 42/25

* cited by examiner

*Primary Examiner* — J. Woodrow Eldred
(74) *Attorney, Agent, or Firm* — Arent Fox LLP

(57) ABSTRACT

A 5.56 mm class bolt for a firearm including a first ejector housing to receive, through a first ejector opening, a first ejector and a second ejector housing to receive, through a second ejector opening, a second ejector.

12 Claims, 2 Drawing Sheets

FIREARM BOLT

CLAIM TO PRIORITY AND CROSS-REFERENCE TO RELATED APPLICATIONS

This application claims priority to U.S. Provisional Patent Application 62/530,297, which was filed on Jul. 10, 2017, U.S. Provisional Patent Application 62/432,739 which was filed on Dec. 12, 2016, U.S. Provisional Patent Application No. 62/411,538, which was filed Oct. 22, 2016, U.S. Provisional Patent Application No. 62/405,195, which was filed Oct. 6, 2016, U.S. Provisional Patent Application 62/366,110, which was filed on Jul. 24, 2016, U.S. Provisional Patent Application 62/342,460, which was filed on May 27, 2016, U.S. Provisional No. 62/326,762, which was filed on Apr. 24, 2016, U.S. Provisional Patent Application No. 62/325,991, which was filed on Apr. 21, 2016, U.S. Provisional Patent Application No. 62/320,432, which was filed on Apr. 8, 2016, U.S. Provisional Patent Application No. 62/311,874, which was filed on Mar. 22, 2016, U.S. Provisional Patent Application No. 62/310,486, which was filed on Mar. 18, 2016, U.S. Provisional Patent Application No. 62/279,887, which was filed on Jan. 18, 2016, U.S. Provisional Patent Application No. 62/245,834, which was filed on Oct. 23, 2015, and U.S. Provisional Patent Application No. 62/210,278, which was filed on Aug. 26, 2015, U.S. patent application Ser. No. 15/248,525, which was filed on Aug. 26, 2016, and U.S. patent application Ser. No. 15/732,225, which was filed on Oct. 6, 2017, the contents of each of which are incorporated herein by reference in their entirety.

DETAILED DESCRIPTION

Figure 1:
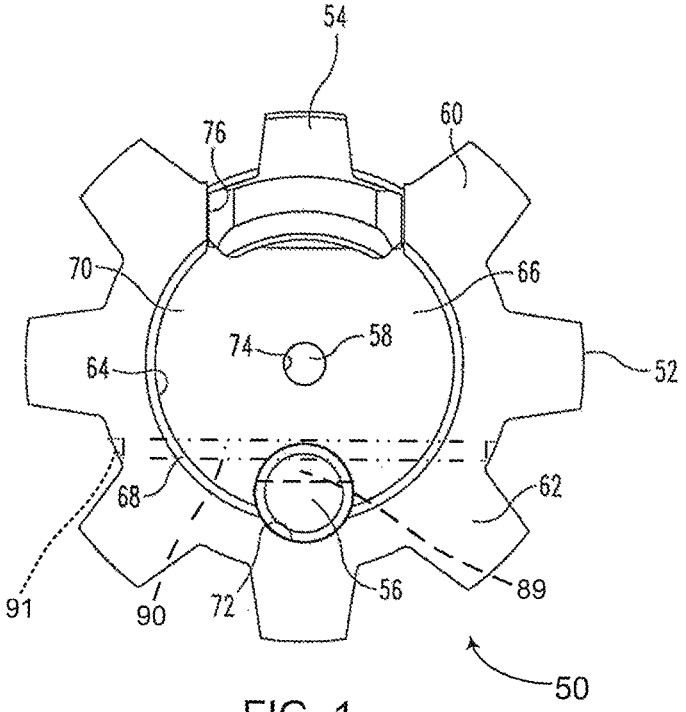
FIG. 1 Related Art
FIG. 1 is a front view of a Technical Data Package (TDP) bolt of the related art.

The M16/AR15 et al Family of Weapons (FoW) is widely used, and has been in service for about half a century. Despite this widespread and long term usage, there are a number of problems in the platform and improvements that can be made.

These improvements bring critical advantage in hunting and sporting applications, and potentially lifesaving enhancements in combat, duty, and self-defense scenarios. While the main focus is on the M16/AR15 FoW and variants thereof, many of the techniques and inventions may be used for a wide variety of other weapons so the disclosure should be considered for any applicable weapon or firearm or system.

The innovations presented herein address inventions related to the M16/AR15/M4/MK18/AR10 et al family of weapons (FOW) and include all applicable variants to include intermediate caliber as well as "piston" as well as "direct impingement" related variants. All such pattern firearms and weapons should be considered without limitation. All numbers and figures should be considered as relative percentages, and vice versa.

Where the design concepts may be applied to other weapons or firearms, they should be considered and regarded as disclosed therein as well.

When given figures are cited they should also be considered relative percentages and vice versa.

Bolt Carrier

Forward Assist (FA) cuts in the Bolt Carrier having a depth different than the TDP depth of .030-.035" maximum are disclosed here—this will permit the use of said cuts with Bolt Carriers which have bodies that are a different size or shape than the standard TDP Bolt Carrier. These cuts may be deeper in the case of wider or thicker Carriers, and they may be shallower (less deep) where carriers are shaped differently or thinner or otherwise have greater clearance between the Receiver wall (or FA "pawl" which engages the cuts). Thinner or shallower cuts also provide less room for fouling to accumulate and provide a cleaner visual image—which creates a distinctive appearance.

Reducing the amount of material protruding under the Bolt Recess bottom to the underside that normally rests upon the cartridges in the magazine—about 0.100" per TDP, is disclosed. This may also be measured from the Bolt Hole Center using a nominal figure of about 0.365"—this includes the 0.100" plus about 0.265" for half the Bolt Hole, taking into account various permitted tolerances.

The reduction to less than this amount in the TDP is disclosed—that is, less than 0.100" from the Bolt recess of the Carrier to the bottom most portion of the Carrier that fits above the cartridges in the Magazine—preferably making it 0.090-.099", more preferably from 0.080-.092", even more preferably from 0.070-.082", and most preferably to as little as 0.070" or less.

Reduction too far can cause the hammer not to "cock" against the trigger or sear—unless the hammer is lengthened as disclosed previously. The hammer may use more than one angle in the portion that is above the area which strikes the Firing Pin. This too permits effective lengthening of the contact surface which has been previously described.

This changed surface dimension—the thinning of the nominal 0.100" portion—reduces the pressure on the cartridges when cycling the action or loading the magazine into the gun. It also reduces the amount of parasitic drag on the Bolt Carrier in cycling when the Carrier is moving rearward (recoil) or forward (counter recoil). This enables the energy in the Action Spring to be released fully in the counter recoil phase when the cartridge is stripped out of the magazine and the round is fed into the chamber. This, coupled with other prior disclosures and the "gas ring" disclosure below ensure maximum effectiveness in cycling operation of the gun.

Cam Path

The use of a Cam Path—defined by TDP as about 0.325" long—which uses less locked "dwell" (less than 0.070" per TDP to about less than about 0.050" to about 0.027-.032") which has been disclosed previously by this author is repeated here. Likewise, a Cam Path which uses less than 0.042" TDP specified "unlocked dwell" is repeated here for clarity. This may use any space less than 0.042", to as little as 0.010-.015" or less, and may be reduced further or even eliminated entirely.

The reduction in "dwell" area permit more space to be used for "unlocking" and "locking" of the Bolt, which reduces forces applied to the Bolt and enhances part life and shooting smoothness—as disclosed previously and repeated here for clarity and emphasis.

This space—the Cam Path—may be increased as stated previously in length to any degree where the Extractor Pin is still covered when the Bolt is fully extended and the Cam Pin is fully forward. Thus this space can be increased beyond the extant 0.213" or so to any degree, and optimally up to 0.260"-0.265" or more, and even as much as 0.270" or more, with further gains being possible with the extension of the Cam Path as disclosed previously and herein by this author. Thus the 0.270" figure cited for reference can easily be extended by 0.001-.020", or even 0.017-.030", and even 0.025-.045" and even more if mechanical changes are made to the Bolt or Extractor or Carrier, for example.

These previously described changes serve to decrease the amount of stress applied in rotational movement over time and distance—as well as delaying extraction of the fired case which results in lower pressure and easier extraction.

The use of a chamfer or radius beyond that called out in the TDP, typically 0.010", is repeated here. A chamfer or radius beyond this—ideally 0.015-.025" or greater—reduces the possible contact area between the Cam Pin and the Cam Path portion of the Bolt Carrier. This promotes more reliable operation especially in austere conditions.

Bolt Rotation

The previously disclosed use of techniques to reduce the "turn rate" of the Bolt locking into or unlocking from Battery (fully closed on the Chamber, ready to fire) is repeated here. Modem firearms and weapons use a turn rate of more than 104 degrees per inch. By transitioning more of the area for rotation to locking and unlocking of the Bolt, and less to "unlocked dwell" or "locked dwell" this can be reduced to less than this and preferably to less than 103-96 degrees per inch, more preferably less than 96-86 degrees per inch, even more preferably less than 86-76 degrees per inch, and most preferably less than 76 degrees or less per inch.

This reduces forces on operating components, notably bolts and bolt lugs- and also delays extraction which is desirable as case pressures are lower. This eases extraction of fired cases and lessens blowback of gas from the bore into the action. This is especially important with suppressed or automatic firearm.

This technique is disclosed for any applicable weapon which uses a rotating Bolt, and is widely applicable.

Cam Pin

The use of more aggressive side area radius is repeated here. Current dimensions of the side contact area of the Cam Pin per TDP have an approximate height measured top to bottom of about 0.093" which are in contact with the Receiver during firing. This contact area creates excessive drag, especially in austere conditions such as a dirty or poorly lubricated weapon. Specifically the radius on the sides of the top of the Cam Pin ("head") which come into contact with the upper receiver—that extend past the TDP radius—are disclosed—this can reduce the length of the side contact portion of the head by 3-10%, preferably by 8-20% or more, more preferably by 15-35% or more, even more preferably by 30-65% or more, and most preferably by 60 to nearly 100%. By making the outer or side contact areas of the Cam Pin Head a constant or nearly constant or mostly constant radius and having the contact area be only a small tangent in contact, the reduction can approach 100%. Additionally, the Head may be further radiused or chamfered or otherwise relieved to reduce contact "height" described above as about 0.093"—beyond TDP to any possible or desired amount—at either the top or the bottom—or both- to further reduce contact area and maximize operating smoothness.

In the most extreme case, the cam Pin will be changed from having 4 flat surfaces on the Cam Pin Head to having only 2 "flats". This will make re-assembly easier than it is with cam Pins which use fewer than 2 flats while providing great advantages in cycling smoothness and austere condition firing.

To ensure ease of installation, the bottom of the Cam Pin shaft may be radiused beyond TDP to any desired amount—this makes installation in the Bolt when re-assembling much easier.

Also, the length of the Cam Pin—from front to back when installed—may be reduced from current TDP dimensions by 1-5%, preferably 4-8%, more preferably 7-12%, and even more preferably by 10-25%. This too makes re-assembly easier, particularly when the Gas Key is enlarged or otherwise larger than TDP.

Vent Holes in Bolt Carrier

The movement of the aft tangent or rear most portion (as compared to the front end or face of the Bolt Carrier) of the Gas Vent holes is repeated here for emphasis. Specifically, this is as compared to TDP positions of extant Gas Vents. In the M16, this is the movement of the rear most tangent of the extant Vent Hole further than about 1.395" (1.3945" plus tolerance stacking) in the current TDP. This can be about 1.3955" to about 1.401", preferably about 1.400" to about 1.405", more preferably 1.404" to about 1.410", and most preferably 1.408" to about 1.420" or more. Similar movements in absolute or relative terms are disclosed for AR10 style (7.62 mm NATO) platforms and other variants are also disclosed.

The previously described use of more holes—especially when not in a straight vertical line—as well as larger vent holes (greater than nominal 0.109" diameter TDP dimensions) are repeated here for emphasis.

These vents help expel exhaust gasses from guns that are frequently over gassed-problems made more severe by the use of Suppressors and shorter gas systems.

Bolt

Various improvements to the Bolt have been made by this author in prior Applications-brought forth again here for emphasis and clarity is the use of more than one Ejector and Ejector Spring in the Bolt.

Figure 2:
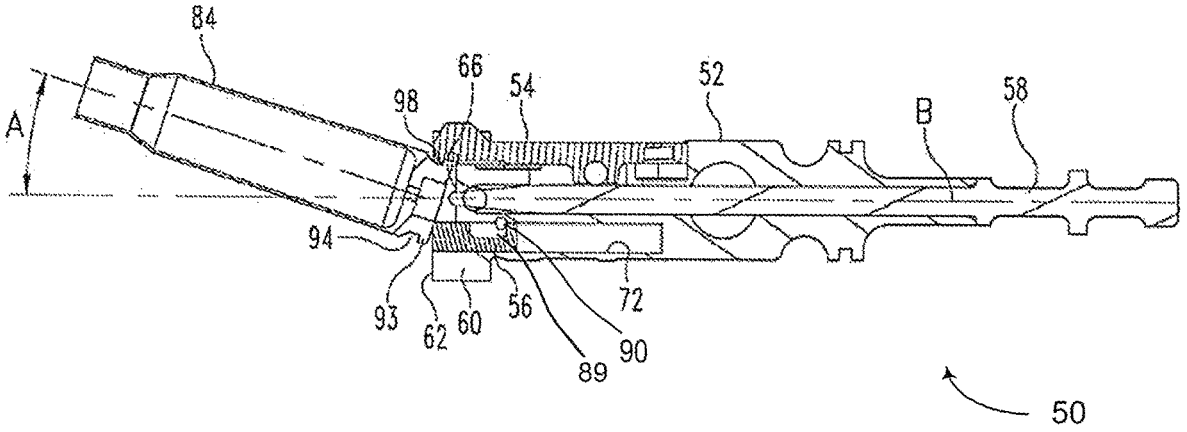
FIG. 2 Related Art
FIG. 2 is a side cross-section view of the TDP bolt of FIG. 1 with the bolt engaged with a casing during ejection.

FIGS. 1-2 show a partial view of an example of a Technical Data Package (TDP) bolt for an AR15® used with 5.56 mm cartridges, components of which may be used in accordance with various aspects of the present disclosure. The bolt 50 includes bolt head 52, extractor 54, ejector 56 and firing pin 58. Bolt head 52 includes a plurality of lugs 60, forward face 62, wall 64, bolt face 66, and chamfer 68. Bolt head 52 also defines recess 70, channel 72, aperture 74, and slot 76. The lugs 60 are constructed and arranged to be received in a corresponding locking barrel in a rotating bolt rifle. Upon assembly of the AR15, lugs 60 pass through corresponding grooves in a barrel or barrel extension and then bolt 50 is rotated to engage lugs 60 with corresponding projections in the barrel or barrel extension to lock bolt 50 in engagement with the barrel of the AR15®. This approach encapsulates a cartridge in the firing chamber and provides rearward containment when the cartridge is fired.

Forward face 62 is the forward (toward the barrel exit end) portion of bolt head 52 and includes portions of each of lugs 60. Wall 64 and bolt face 66 define recess 70 in bolt head 52 that is constructed and arranged to receive the base of a cartridge to be fired in the AR15®.

Channel 72, which may hereinafter be interchangeably be referred to herein as an "ejector housing," may be constructed and arranged to receive ejector 56 and a biasing member (e.g., a spring) that biases ejector 56 to protrude beyond bolt face 66 to be approximately flush with forward face 62. The ejector 56 may be cylindrically shaped and configured to be received within channel 72. The ejector 56 may further include a cutout 89 (FIG. 2). Once the ejector 56 and the biasing member are pressed within channel 72, the ejector 56 may be slideably contained within the channel 72 via a retaining pin 90 that is receivable within a retaining pin channel 91. The retaining pin 90 passes through the cutout 89 and thus contains the ejector 56 within the channel 72 once the retaining pin 91 is installed into the retaining pin channel 91.

As shown in FIG. 2, the ejector 56 may be located so as to be flush with bolt face 66 when a cartridge is received in recess 70. Ejector 56 (with the biasing member) may provide a biasing force against the cartridge 84 that promotes ejection of spent cartridges as part of the action of the AR15® when operated. Aperture 74 may be constructed and arranged to a receive firing pin 58 and to allow the firing pin 58 to protrude beyond bolt face 66 to strike a primer in the received cartridge when the AR15® is in operation, as is well known in the art. Slot 76 may be constructed and arranged to receive extractor 54 and to allow extractor 54 to move radially away from bolt face 66 when a cartridge is received into recess 70.

FIG. 2 further illustrates the bolt 50 and a casing 84 as positioned during the extraction process for the TDP bolt. In particular, in the condition wherein bolt 50 has moved rearwardly (away from the barrel exit end) in the action of the AR15® so that casing 84 clears the chamber of the barrel and ejector 56 has extended to its forward position so as to be substantially flush with forward face 62, thereby causing casing 84 to rotate about projection 98 during operation of the AR15. In FIG. 2, the angle between longitudinal axis of a bolt head 52 and longitudinal axis of casing 84 is shown as angle A. As shown in FIG. 2, angle A may be approximately 18°. The process of forward movement of ejector 56 during operation of the AR15® may impart angular momentum, combined with moving casing 84 rearwardly, resulting in casing 84 continuing to rotate about projection 98 and to eventually leave the firing chamber, thereby making room for a subsequent round to be loaded for firing, by virtue of the return stroke of bolt 50 moving forward.

Aspects of the current disclosure relate to several improvements to the TDP bolt described above by providing dual ejectors while maintaining the compact dimensions of the TDP 5.56 mm class bolt (e.g., AR15® bolt as shown in the above example). Dual ejectors along the lines as shown and descried in the present disclosure provide several advantages, including: greater force in ejecting spent cases and additional redundancy should one of the ejectors become fouled, or break, or should one of the springs within ejector casing suffer from a malfunction or breakage, for example.

Figure 3:
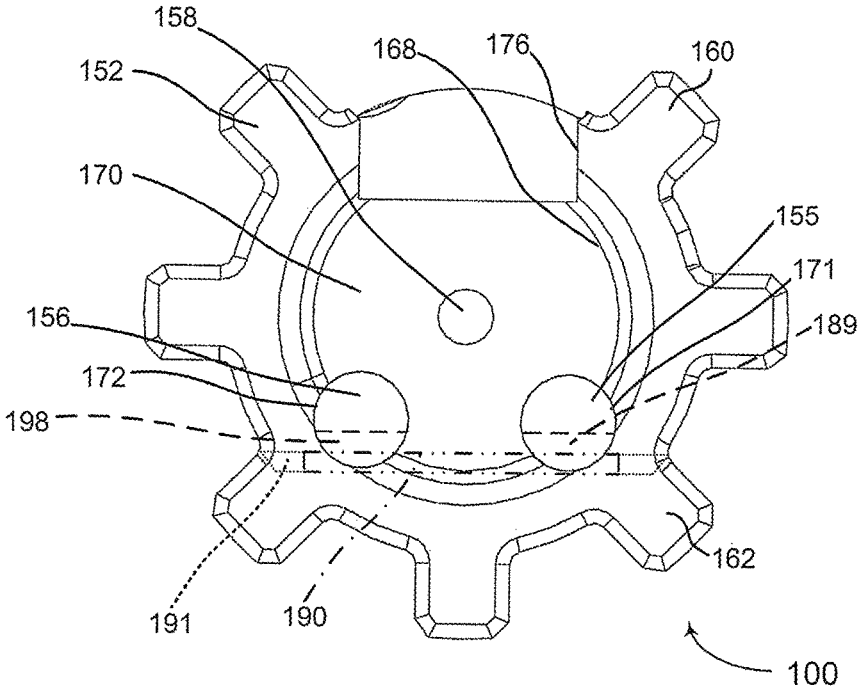
FIG. 3 is a front view of various features of an example bolt for use in accordance with one aspect of the present disclosure.
Figure 4:
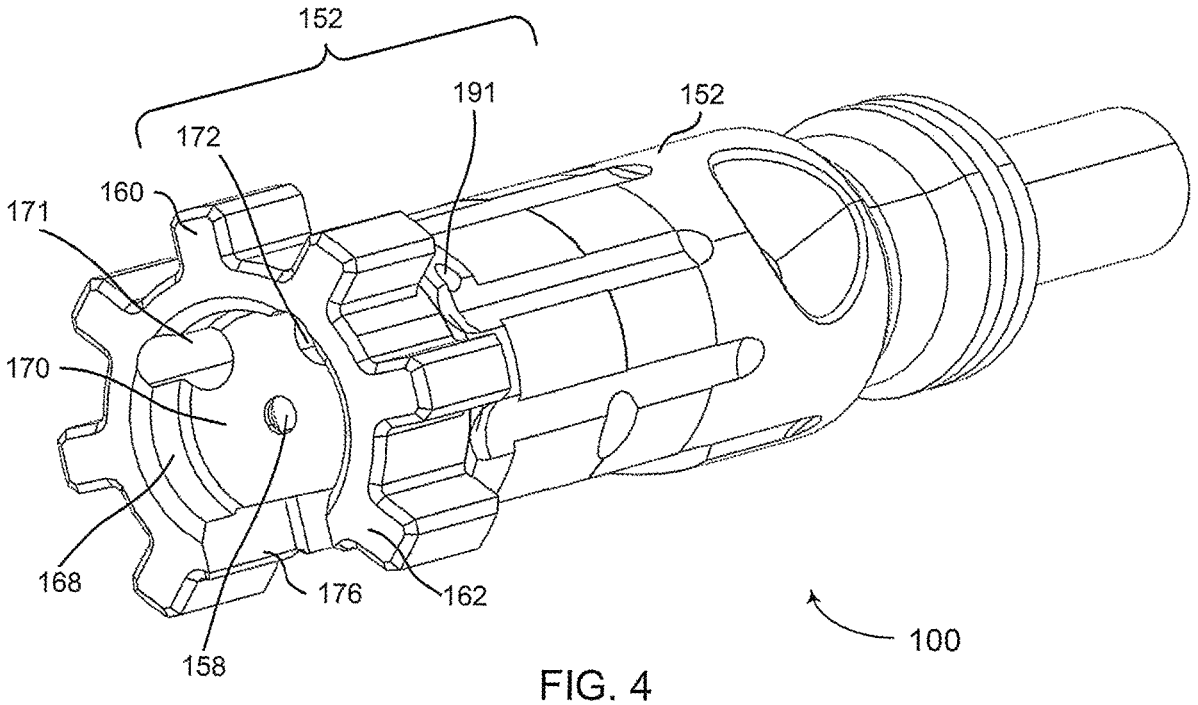
FIG. 4 is a perspective view of the example bolt of FIG. 3.

As shown in FIGS. 3-4, aspects of the current disclosure allow for two, or Dual Ejectors/Springs, while using approximately the same size assembly as the current TDP Bolt. Further, a bolt along the lines of the current disclosure may allow for the use of two ejectors and springs that are common components of a 5.56 mm class bolt, thus allowing, among other things, ease of replacement and sourcing of components (e.g., ejectors, springs, and retaining pin) for the disclosed bolt.

FIGS. 3-4 show a partial view of an example bolt for use in accordance with one aspect of the disclosure. In one example implementation, the bolt may be usable with an AR15® and/or used with 5.56 mm cartridges. The bolt 100 may include a bolt head 152, and an extractor slot capable of receiving an standard 5.56 mm class extractor (e.g., extractor. 54 in FIG. 2). The bolt 100 may further include lugs 160, which may be constructed and arranged to be received in a corresponding locking barrel in a rotating bolt rifle. In assembly of the AR15® for use with various aspects of the present disclosure, lugs 160 may be extended through corresponding grooves in a barrel or barrel extension, and then bolt 100 may be rotated to engage lugs 60 with corresponding projections in the barrel or barrel extension to lock bolt 100 in engagement with the barrel of the AR15®. This approach encapsulates a cartridge in the firing chamber and provides rearward containment when the cartridge is fired.

The bolt 100 may further include a firing pin slot 158 capable of receiving a standard 5.56 mm class firing pin (e.g., pin 58 in FIGS. 1 and 2). The bolt head 152 may further include a plurality of lugs 160, a forward face 162, wall 168, and bolt face 170. Bolt head 152 may also define a recess 170, a first ejector casing 171, a second ejector casing 172, and a retaining pin channel 191.

By moving the retaining pin channel radially outward to the outboard side each of the first ejector casing 171 and second ejector casing 172, and by rotating the orientation of the first ejector 154 and second ejector 155 during assembly in accordance with aspects of the present disclosure, as compared to conventional TDP assembly of the related art, more than one ejector (e.g., a first ejector 154 and a second ejector 155) may be fitted using a single ejector retaining pin 190 (FIG. 3). In one example, the orientation of the first ejector 154 and the second ejector 155 when installed into respective first ejector casing 171 and second ejector casing 172 in accordance with aspects of the present disclosure is changed approximately 180 degrees as compared to the orientation of the TDP single ejector (e.g., ejector 56 in FIG. 1) of the related art, so that the first ejector pin cutout 198 and second ejector pin cutout 189 upon assembly face outwardly, rather than inwardly. This approach permits two standard ejectors to be retained with a single retaining pin 191. This eases logistical challenges of introducing new parts into the supply system. Twin Ejectors have shown significantly improved performance in ejection in test firing compared to a single Ejector.

Improving the strength of the Extractor is a critical priority. Careful examination by this author has shown that more material may be used than is present in the TDP Extractor while preserving proper operation of the weapon. The cuts on either side of the Lug on the Extractor may be reduced in depth or eliminated entirely to increase the amount of material and strength of the Extractor. This improvement is repeated here for clarity.

As previously stated, the diameter of the Bolt Body may be increased to over 0.515", and the diameter of the Wear Ring or Band may be increased to over 0.528" or 0.5285" in size.

Gas Ring

Careful examination of various size Gas Rings on the Bolt, operating within mil spec (TDP) Carriers has shown dramatically increased friction, even when undersized as compared to TDP specs (0.512" OD+1-0.001"). Even undersized Rings (e.g. 0.508"-0.510") in clean, lightly lubricated scenarios require 2-3 pounds of pressure to close the Bolt. This is dramatically increased with dirty or unlubricated weapons, and robs the weapon of the necessary spring energy (nominal approx. 6 lbs when new) to cycle the gun and close the action, chambering a new round. In other words half or more of the available energy can go to a minor task. This causes failure to cycle or failure to feed.

Sharp edges and rough surface finish on the outer diameter of the Gas Ring can create excessive friction and wear, and lead to greater probability of tearing. Even the permitted edge sharpness and finish quality of TDP gas rings are not optimal. The rings tend to "dig" the sharp edge into the Bolt recess of the Carrier and create dramatically elevated friction.

These factors can rob the Action or Recoil Spring of the necessary energy to chamber the cartridge and lock the Bolt into Battery which is often seen as a "failure to feed" or "failure to lock" malfunction.

Adding too much spring to overcome this can lead to the gun "short stroking" or otherwise failing to fire and cycle normally.

This author has noticed that even much smaller rings (<0.508-.510" or less) will keep the Bolt from falling out of the Bolt Carrier when held downwardly. This includes heavily used, worn rings down to the smallest applicable area tried so far (as little as 0.494-.499" or so to about 0.505"-0.508" in size with a preferred and optimal range of about 0.500-.503"). This reduces the force required to move the Bolt within the Carrier, as described above to less than about 1-1.5-2 lbs, and preferably down to 0.5-15.9 oz with a more preferable range of about 2-10 oz. These cycle the gun properly in experiments, enable normal fire to include full automatic, and prevent excess gas blowby past the rings. The measured force for smaller rings used on Bolts result in closing forces that are much smaller, often in the ranges of ounces to well under a pound. This will retain the Bolt within the Carrier when held downwardly with tension from the rings alone. In most cases this will also support the weight of the Carrier when resting upon the Bolt. This reduces the amount of Spring force lost to parasitic friction of larger gas rings and promotes more reliable operation.

Thus the use of smaller and better finished and fully radiused edges than TDP specification gas rings used on the Bolt to promote normal firing operation and enhance reliability is disclosed.

Buffer

Reducing the thickness of the TDP Buffer face which is currently about 0.250" longas measured front to back, enables more spring action or movement as well as providing more space for the Recoil or Action Spring when it is in the maximum compressed position—this is repeated here for clarity. So too is the use of more aggressive chamfers or radius—more than the amount called for on the TDP, usually 0.010"—on both the front and rear edges of this portion of the Buffer to promote greater smoothness of operation and reduce any binding or friction. This may include figures of 0.015-.020", and preferably 0.020-.040" or more as disclosed herein and previously. The entire outer edge of the Buffer face may be changed from current straight shape to a radiused shape as measured front to back.

Spring

The use of a "carbine" action or recoil spring with less than 2.874" (TDP) "solid height" (or fully compressed length) to enable longer stroke or movement of the Bolt Carrier—without spring bind or stack which would impede "enhanced stroke" or carrier travel is disclosed. Experimentation by this author on his invention of an enhanced Carrier and Buffer has shown that additional room within the Buffer Tube and consistent spring force is highly desirable.

Study has shown that a normal TDP spring, and "enhanced" (or commercial improved) springs preclude full travel of enhanced stroke buffer/carrier combinations previously disclosed.

The use of a spring with a "solid height" (fully compressed with no space between the coils) of less than the TDP (2.874") is disclosed. This can be accomplished by reducing the coils from 38, reducing the wire thickness from about 0.072", or a combination, or of using advanced flat wire springs which permit full extended movement without unduly stressing the action spring. In any case the use of a normal power spring in Carbine (and other as applicable) systems wherein the maximum compressed length ("solid height") is smaller than current TDP, and preferably 2.80-2.873" or less, more preferably 2.50-2.80" or less, and most preferably 2.00-2.50" or less is disclosed—in order to capture the full range of movement in enhanced stroke (>nominal 3.75-3.755" or so current TDP stroke) systems using different Carriers/Buffers as described by this author is disclosed.

The use of a Spring which has a "solid height" that is shorter than TDP as stated above will carbine and other systems—most crucially "long stroke" systems as described (>TDP stroke of about 3.75-3.755") to operate at their full capacity and efficiently do so.

The "load rate" should also be less than called for in the TDP (believed to be about 2 lbs/inch) to enable the system described above to take full advantage of available action travel or "stroke" without "over springing" the gun. By that, it means using so much spring that the gun cannot cycle in normal conditions and "short strokes" or fails to cycle properly.

The use of a spring with a wire width greater than 0.072" and wire thickness less than 0.072" with fully radiused contact edges is disclosed.

Similar applications may be made in other length systems imparting enhanced stroke as well—such as Rifle, or PDW, or A5 systems as well.

Gas Key

The previously disclosed use of single "bore hole" size, which eliminates gas bottlenecks and improves ease of manufacture is repeated here. This avoids multiple diameter reductions found in the current art—these constrict gas flow. Likewise the change in the angle of the "45 degree hole" to a hole angle steeper or greater than 45 degrees is repeated. This enables the use of a larger hole due to reducing the size of the "ellipse" in length relative to width due to the angle—this also reduces gas flow bottlenecks. In severe cases of overgassing, this change reduces the amount of the Key subject to blow back.

Effectively, the increased size of the Hole, previously disclosed, more closely or exactly matches the corresponding "vent hole" in the Carrier, to maximize gas flow.

Again, this helps reduce backpressure in overgassed guns—as it presents less "key" surface for gas to blow back against—extant in TDP hole (ellipse shape).

Charging Handle

The use of oversized contact area in the charging handle disclosed previously, is repeated here. This can be combined with other previously disclosed techniques to reduce actual "contact area". These methods can include the use of slots, rails, sand cuts, dimples, and any other method to reduce the actual or potential contact area of the charging handle that contacts the Upper Receiver "slot", which reduces the effect of debris or fouling in the action while maximizing the stability of the charging handle in operation.

Ambidextrous Bolt Catch/Bolt Release

A persistent fault of the M16/AR15 FoW and variants is the inability for a right handed shooter to rapidly and easily lock the Bolt in a rearward position when unloading the weapon, clearing malfunctions, or normally handling the firearm. The need to use the left hand to send the Bolt forward when reloading slows the time required to get "back on target" after reloading.

Current attempts at solving this issue run into a host of problems—most having to do with interference in operation with the Dust Cover, which opens upon a shot being fired. The mechanisms either run into the Dust Cover or use a number of long arms or complex mechanisms. The exposed arms or complex mechanisms are subject to breakage in rough conditions.

By using a rearward movement or extension of the Bolt Catch prior to exiting the Receiver-ideally at an angle other than 90 degrees (i.e. perpendicular to the Bore), the shortest path to optimal placement is made. This minimizes the material and weight of any extension, which promotes maximum functionality while minimizing cost. While this can include an Angle between that parallel to the Bolt Catch Cut in the Lower Receiver and perpendicular to it, the use of a Curve or Radius to achieve the same goal is disclosed as well. Further a combination of Angle or Curved is disclosed as well.

The portion ("Arm") extending as described from the normal (TDP area) Bolt Catch may be a single piece with the Bolt Catch, or it may be more than one piece. It may be integrally formed, or attached separately. It may be temporary, semi permanent, or permanent. It may be the same weight/density and material as the Bolt Catch, or it may be different. It can also be directly connected as shown, or it may use any type of lever, gear, or other compound or mechanical action to activate.

It may be connected or built directly to any applicable or conceivable portion of the Bolt Catch, and the Bolt Catch Channel may be enlarged or modified in any applicable way to accommodate the Arm. Likewise, and enhanced or TDP Bolt Catch may be modified to use the Ambi (ambidextrous) and "Angled" Bolt Catch extension Arm.

This enables the Receiver to be transmitted at the thickest, strongest part of the Lower as shown by the following picture of an initial firing prototype. These features have been previously described by this author but they are clearly visible in the firing prototype shown, and are graphically shown for clarity.

Lower Receivers may be easily modified or newly manufactured to accommodate such an Ambidextrous Bolt Catch by making the Bolt Catch slot in such a way to accommodate the mechanism. Most—at least 65%—of the mechanism of the Arm can be shielded by the lower receiver. The Pad may be below the upper edge of the Lower Receiver but above the Magazine Release so as to not interfere with reloading.

The extension to the Bolt Catch hole in the Receiver, and the Arm, may extend at any applicable angle and may also move downwardly to promote clearance between the Arm and the Upper Receiver.

Preferably any extension outwardly greater than about 0.125" from a normal TDP Bolt Catch, as well as the pad or control surface will be below the Pin Hole which anchors the Bolt Catch to the Lower Receiver.

The slot in the Lower will ideally be lower in position than the Bolt Catch slot itself, which allows for more articulation and clearance of the Arm.

Modular Pads

The use of various size, shape, angle, and weight control surfaces—made previously by this author—is repeated here for clarity. These may be made of materials similar in density and substance to the Bolt Catch, and they may also be made of lighter or denser materials.

The modular nature of these interchangeable pads is repeated here—they are conceived to interchange by the user and be attached either temporarily or permanently as desired. They may be attached in any desired manner, for example by mechanical shape or various attachment mechanisms such as screws or bolts without limitation.

This allows the user to choose between different applications (e.g. competition, or duty, or sport, or combat, as example) as desired. This also enables the user to adjust or otherwise move the center of gravity (CoG) about the "pin" that mounts the Bolt Catch to the Lower Receiver. This optimizes functionality and reliability of the assembly. Essentially the adjustment in the CoG can be used to more effectively activate the Bolt catch and offset any added weight of an ambidextrous "arm" or extension.

Pads

The Pads may flare towards or away from the Receiver or Bore. This enables them to be tucked in closely if desired to minimize snagging- or they may flare outwardly for instance in sporting or competition applications.

The normal position for control surfaces of the Bolt Catch is to be parallel to the Lower Receiver—these innovations enable the Pads or control surfaces to be parallel or non-parallel as desired.

What is claimed is:

1. A 5.56 mm class bolt for a firearm, comprising:

a first ejector housing configured to receive, through a first ejector opening, a first ejector, a second ejector housing configured to receive, through a second ejector opening, a second ejector; and a retaining pin housing extending along a first axis, wherein the retaining pin housing intersects the first elector housing and the second ejector housing.

2. The 5.56 mm class bolt of claim 1, wherein the first ejector includes a first cutout, and the first ejector is retained in the first ejector housing.

3. The 5.56 mm class bolt of claim 2, wherein the second ejector includes a second cutout, and the second ejector is retained in the second ejector housing.

4. The 5.56 mm class bolt of claim 3, further including a single retaining pin disposed in the retaining pin housing to engage the first cutout and the second cutout to retain the first ejector in the first ejector housing and to retain the second ejector in the second ejector housing.

5. The 5.56 mm class bolt of claim 4, wherein the retaining pin is disposed at least partially within the first cutout and at least partially within the second cutout.

6. The 5.56 mm class bolt of claim 4, wherein the first cutout is disposed to face outwardly relative to the bolt and wherein the second cutout is disposed to face outwardly relative to the bolt.

7. The 5.56 mm class bolt of claim 4, wherein the first cutout is aligned with the second cutout.

8. The 5.56 mm class bolt of claim 5, wherein the first cutout includes a first retaining pin contact surface, the second cutout includes a second retaining pin contact surface, and wherein the first retaining pin contact surface is at least substantially parallel to the second retaining pin contact surface.

9. A bolt for a firearm extending along a first axis, comprising:

a first ejector passage having a first opening on a face of the bolt and extending along a second axis, wherein the first ejector passage is configured to retain a first biasing member and a first ejector received via the first opening;

a second ejector passage having a second opening on the face of the bolt and extending along a third axis that is parallel to the first axis and the second axis, wherein the second ejector passage is configured to retain a second biasing member and a second ejector received via the second opening;

a retaining pin passage extending along a fourth axis that is perpendicular to the first axis, second axis, and third axis, wherein the retaining pin passage communicates with the first ejector passage and the second ejector passage and is configured to receive a retaining pin that retains the first biasing member, the first ejector, the second biasing member and the second ejector.

10. The bolt of claim 9, wherein the bolt is a 5.56 mm class bolt.

11. The bolt of claim 9, further comprising:

the first ejector contained within the first ejector passage, wherein the first ejector includes a first cutout;

the second ejector contained within the second ejector passage, wherein the second ejector includes a second cutout;

the retaining pin contained within the retaining pin passage, wherein the retaining pin interacts with the first cutout and the second cutout thereby limiting movement of the first ejector within the first ejector passage and the second ejector within the second ejector passage;

the first biasing member contained within the first ejector housing and configured to bias the first ejector; and the second biasing member contained within the second ejector passage and configured to bias the second ejector.

12. The bolt of claim 11, wherein the first cutout is disposed to face outwardly relative to the bolt and wherein the second cutout is disposed to face outwardly relative to the bolt.

* * * * *